US006353944B1

(12) United States Patent
Clayton

(10) Patent No.: US 6,353,944 B1
(45) Date of Patent: Mar. 12, 2002

(54) WASH BASIN WITH PROTECTIVE WATER FILM

(76) Inventor: Keith Kaar Clayton, 2143 N., Hudson Ave., Chicago, IL (US) 60614

( * ) Notice: Subject to any disclaimer, the term of this patent is extended or adjusted under 35 U.S.C. 154(b) by 0 days.

(21) Appl. No.: 09/246,244

(22) Filed: Feb. 8, 1999

(51) Int. Cl.[7] ..... E03C 1/12
(52) U.S. Cl. ..... 4/651; 4/653
(58) Field of Search ..... 4/262, 263, 591, 4/650, 651, 653, 679, 680, 662, 671, 673, 674, 678

(56) References Cited

U.S. PATENT DOCUMENTS

| | | | | | |
|---|---|---|---|---|---|
| 64,982 | A | * | 5/1867 | Ivers | 4/651 |
| 955,143 | A | * | 4/1910 | Dunbar | 4/653 |
| 1,512,193 | A | * | 10/1924 | Berven | 4/591 |
| 1,656,194 | A | * | 1/1928 | Hazlitt | 4/262 |

FOREIGN PATENT DOCUMENTS

| | | | | |
|---|---|---|---|---|
| GB | 11680 | * | 8/1884 | 4/651 |
| GB | 10533 | * | 5/1907 | 4/651 |
| GB | 7220 | * | 3/1912 | 4/263 |

* cited by examiner

*Primary Examiner*—Robert M. Fetsuga

(74) *Attorney, Agent, or Firm*—Chapman and Cutler

(57) ABSTRACT

A wash basin, as for a domestic bathroom, has normal inlet water faucet(s) and spigot(s) fitted at or above its top and a normal outlet or drain pipe at its bottom. The basin also has a peripheral inlet flow channel formed below its top rim, for creating a smoothly-flowing film of water cascading down the interior sides of the basin to the outlet. This flowing water film intercepts detritus such as shaving cream, toothpaste, and soap, preventing it from sticking to and soiling the interior of the basin. The basin preferably also has a peripheral overflow channel formed in its side wall adjacent but spaced from the peripheral inlet channel and communicating to the drain below any drain plug or stopper that may be used. The inlet flow channel preferably has a separate water supply and control so that it may be used either separately from or in addition to the regular water supply and so that it may alternatively be left off even while the regular water faucet(s) and spigot(s) are in use. The supply to the inlet film channel can be of hot, cold, or tempered water or may be adjustable by a user as to flow volume and/or temperature, as may be desired and permitted by the plumbing setup. The overflow channel and downstream passages to the drain are sized to pass the maximum volume of flows from the spigot(s) and the inlet channel combined, to avoid overflow of and spilling of water and other contents from the basin under most circumstances. The basin thus provided is clean and dramatic in both its interior and its exterior aspects, multiplying its use possibilities atop as well as inset into domestic cabinetry.

7 Claims, 1 Drawing Sheet

WASH BASIN WITH PROTECTIVE WATER FILM

FIELD OF THE INVENTION

The present invention relates to wash basins for domestic use, particularly in contemporary design settings.

BACKGROUND OF THE ART

Wash basins and sinks are now a common domestic or household feature for bathrooms and "powder" rooms, usually set into or mounted at their upper rims onto a countertop and equipped with hot and cold water faucets or controls and a single spigot, an overflow passage, and a bottom drain with a closable stopper. Such basins and sinks occasionally, and now more commonly, are formed as were old-time simple basins or bowls, like a porcelain bowl simply set atop a surface without plumbing, but actually having running water.

All such basins and sinks suffer the problem that soap, dirt, toothpaste, hair, shaving cream, and other detritus from their users often drops onto the surface in the basin or sink. The detritus must be separately washed away by the user, unless it happens to fall into the flow from the spigot itself, but that flow is not intended to cover all the inside surface of the basin or sink. Where the detritus is not separately rinsed away, it can be very unappealing to users who come later. When it dries, it can become difficult to remove without use of specific cleaning products.

Although sinks have been known with similar structures or intended functions, none has provided the function in an aesthetically pleasing and fully functional way. Cheng U.S. Pat. No. 4,231,123 shows a plurality of separate inlet and overflow slots formed about the upper, inner periphery of an inset sink structure, with temperature controls for the inlet water, but no separate, main water inlet; that is, all water comes into the basin through the peripheral inlets, as in a toilet or dentist's spittal receptacle with whirling flow. U.S. Pat. No. 913,323 shows separate cocks for introducing water to a public washbasin and a whirling internal flow through jets 13. Cohen U.S. Pat. No. 1,426,046 is similar, for a sink or bath tub.

SUMMARY OF THE INVENTION

An object of the present invention is to provide a useful and attractive domestic wash basin or sink having a film of flowing water protecting the interior of the basin or sink from deposits of detritus such as soap, dirt, hair, toothpaste, shaving cream, and the like often accompanying the use of such utility. The sink or basin of the invention has the usual water spigot fed by faucets for controlling the flow into the basin, for hand washing and the like. A uniform peripheral water inlet about the inside surface of the bowl below the upper rim creates a smooth downward flow of water in a thin film on all sides of the basin from the water film inlet to the basin drain. A similar peripheral water overflow port or channel is formed in the inside surface of the bowl below the water inlet channel, for removing excess water as when the drain is blocked but water continues to come into the bowl. The water coming through the peripheral inlet may be hot, cold, tempered, or adjustable in temperature, and its volume may be set automatically or be adjustable by a user. The spigot and the water film flow may be used together or separately, either one without the other, if so structured in the plumbing connections.

THE PREFERRED EMBODIMENTS

Figure 1:
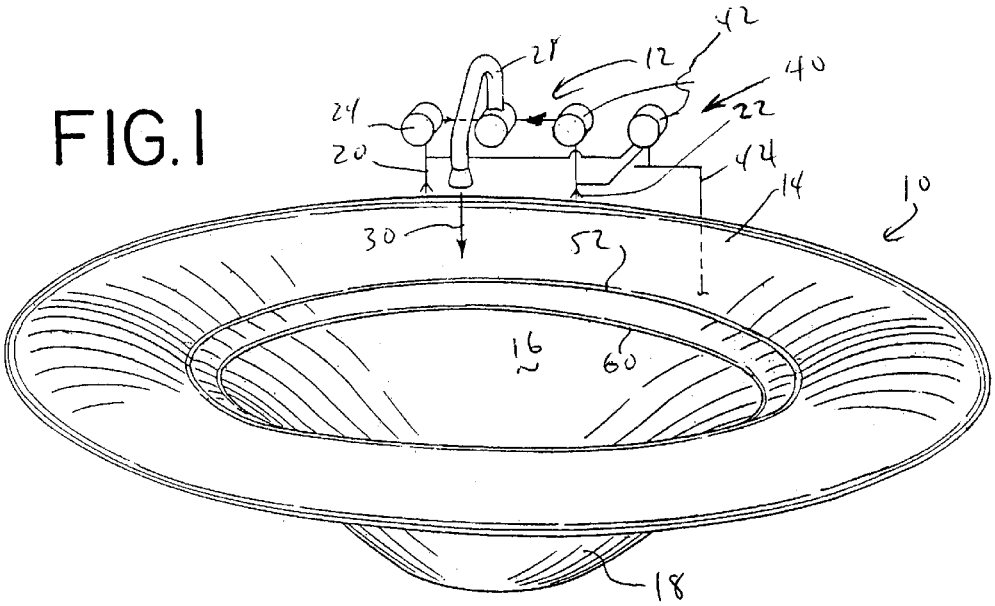
FIG. 1 is a perspective view, partly schematic, from the top front of a sink or basin made in accordance with the invention.

A sink or basin in accordance with the invention is shown at 10 in FIG. 1, with the water supply plumbing 12 shown schematically above an upper rim 14 of the structure. The basin 10 is advantageously made of ceramic or porcelain material, cast with internal passages and hollows as shown and finished with a hard and durable glaze, although it may be of other suitable material. In the form shown it is finished on both the inner, top side 16 and the outer, lower side 18, so that it may be mounted atop a table or cabinet (not shown).

Potable water is supplied to the sink or basin 10 by normal hot and cold water pipes 20, 22 supplying faucets 24, 26 which regulate the flow of water to the spigot 28 both as to temperature and as to volume, as is well known. Alternative arrangements such as single-handled faucets, wholly separate controls, and the like are also well known and not shown here. The result is a selected, user-controlled flow of potable water 30 downwardly and onto and into the interior 16 of the bowl 10 for use. The water, now used and "grey", will flow with any soap, dirt, etc. out the drain opening 32 as in FIGS. 2 and 3, if that is open and not blocked by a plug (not shown). Such a plug will engage the surfaces 34 at the gravitational bottom of the inside surface 16 of the bowl 10.

Figure 2:
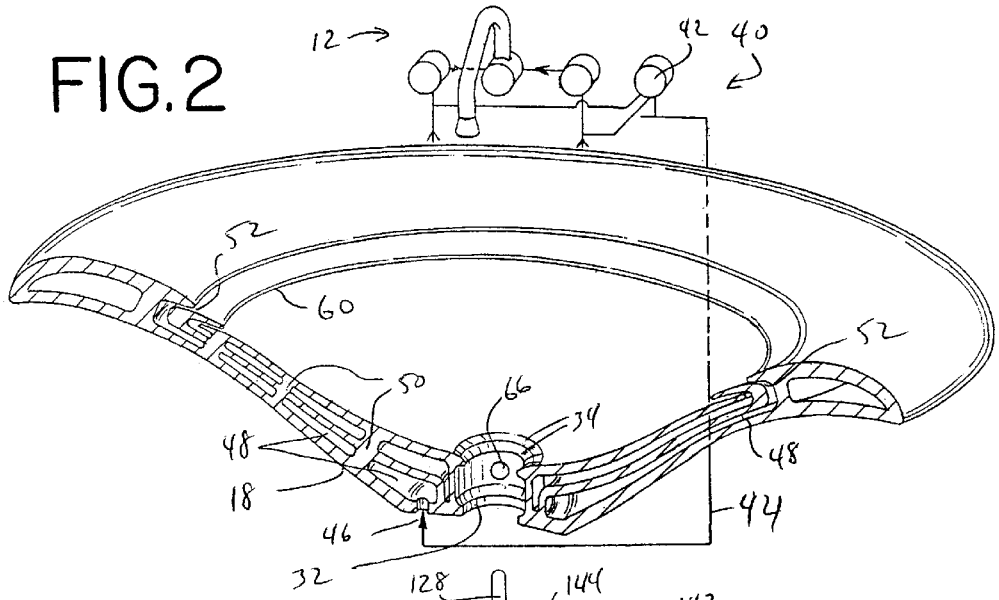
FIG. 2 is a perspective view, partly in section and partly schematic, from the top left front of a sink or basin made in accordance with the invention.
Figure 3:
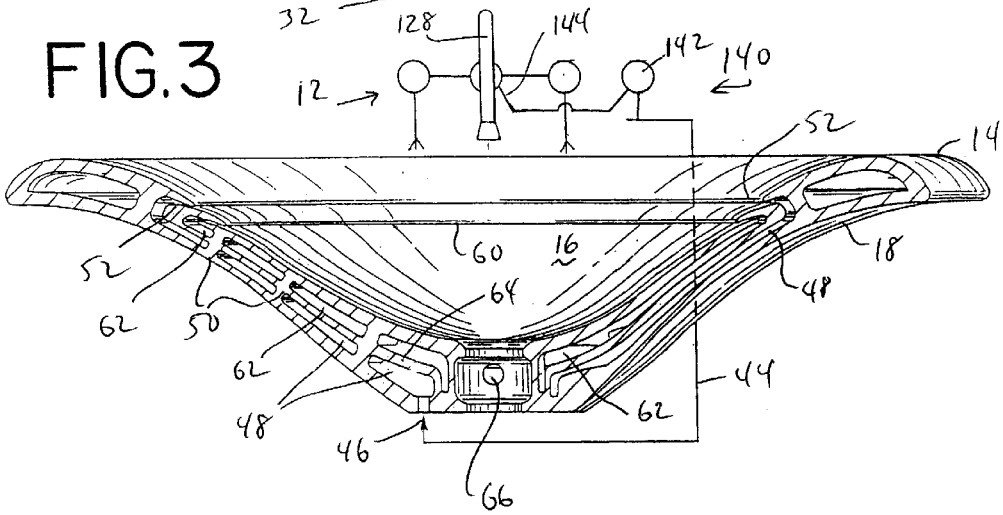
FIG. 3 is a front sectional view, partly schematic, of a sink or basin made in accordance with the invention, and with an alternate water film supply connection.

Parallel to the main water inlet system 20 to 28 and 30 is, in accordance with this embodiment of the invention, a water film supply system 40 as in FIGS. 1 and 2 and 140 in FIG. 3. The system 40 is tapped from the hot and cold water supply pipes 20, 22 and controlled by a film flow faucet of the single-handle type, shown at 42. This faucet 42 will control the temperature and the volume of water flowing into inlet film pipe 44, by known means such as turning controlling the temperature and tilting controlling the volume. Either or both such controls can be dispensed with, for instance providing a fixed volume of flow and/or a set temperature of water for the film flow, or varying the film flow volume and temperature directly with that of the main spigot flow 30 through a simple diverter port or valve in the spigot 28.

In the alternative water film supply system 140, shown schematically in FIG. 3, the spigot 128 is tapped by a water line 144 going to a volume control valve 142. By this connection, water at the temperature of, and proportional to the volume of, that going into the basin from the spigot is supplied also to the water film supply line 44, to flow into the inlet flow channel 52 as in the other embodiment. The supply volume to the water film can be reduced, but not substantially increased, by the faucet 142. This system is simplified in use, as the faucet 142 can be set for average conditions and will always provide a suitable water film without separate actuation of the valve as in FIGS. 1 and 2, above.

The water film flow pipe 44 in either embodiment joins to the base of the basin 10 at 46 through a suitable connection, not shown, into an internal passage 48 formed within the outer wall 18 of the basin. The basin 10 is reinforced across the passage 48 by islands 50 of the same ceramic or porcelain material as the basin 10 is cast of. Although the sections of FIGS. 2 and 3 are taken through islands 50 on the left side of the drain 32, water in the passage 48 flows about and around the islands 50 upwardly though the peripheral wall of the basin 10, as is seen on the right side of each figure. The water from passage 48 then flows evenly out of a substantially uninterrupted, peripheral, film-forming inlet passage 52, and down the inside surface 16 of the basin 10. This water preferably does not spray out from passage 48 and inlet 52, and has no circumferential component about the basin, but flows out evenly, adhering to the surface 16 of the basin. Because the water film thickness increases as it approaches the drain 32, even the heavier deposits and accumulations of detritus are carried forcefully away.

A water overflow passage, required by good practice and most plumbing codes, is incorporated into the basin 10 via an overflow port 60 extending peripherally about the inner surface 16 of the basin 10, below the water film inlet 52. The overflow port communicates to a passage 62 inwardly of the inner basin wall 16, and separated from the overflow water flow passage by a wall 64. The wall 64 is supported by the same island structures 50 as support the opposing walls of the passage 48, noted above, and water within the passage 62 flows about these islands and downwardly to an outlet 66 to the drain 32 beneath the surfaces 34 supporting any drain plug. The passages are sized to receive and pass a greater volume of water flow under gravity than can reasonably enter the basin 10 through the spigot 28 and water inlet passage 52 under local water pressure, to prevent overflowing of water past the port 60 and even the topmost part 14 of the rim of the basin 10. The passages shown in the drawings are not to any uniform scale.

Alternatively, a simple circular or other simple, local opening in the inner wall of the basin and leading to the drain below the surfaces 34 can be employed with the novel water inlet flow channel system of this invention.

The basin 10 with its interior wall 64 and islands 50 and passages 48 and 62 may be formed by conventional if complex casting techniques, including lost wax and plastic foam displacement, or by forming the pieces separately and joining them together in halves or shells before finishing and glazing.

A bleed hole can be provided between the passages 48 and 62, for draining standing water from the water inlet to the outlet 66 when the sink or basin is not in use, subject to plumbing codes barring possible backflow of gray water into the water supply system in case of any pressure drop therein. Similarly, a separate drain can be provided in the pipe 44 connecting to drain beyond the drain plug surface 34.

In use, the basin 10 is mounted in or on a selected surface at a selected height for convenient use. The embodiment shown is adapted for setting on a table top cut out only for a drain from passage 32 and for the water film supply pipe 44, as at 46. The water connections are made as indicated, to the faucets 24, 26, and 42, for instance inside a wall behind the sink or basin 10. The spigot 28 should discharge its water stream into the basin 10. The water film supply pipe 44 is connected to the basin at 46, and the drain is connected to the basin at 32. A user will turn on the water film at the faucet 42, adjusting same for an appropriate film from inlet 52 down the inside of the basin 10 on surface 16. The user then will adjust the main water inlet from spigot 28 in stream 30 by adjusting the hot and cold faucets 24, 26. The water film will form inside the basin 10 on surface 16, and the film will pass to the drain 32 any soap, dirt, toothpaste, hair, shaving cream, and the like that the user deposits into the basin 10 which otherwise may simply be deposited on surface 16. The water film on surface 16 being thin and smooth, it may not even be noticed except as to its action in so carrying away detritus from the use of the basin.

If a drain plug is placed into the position bounded by surfaces 34, to block flow of water from the inside of the basin 10 to the drain 32, then water will back up in the basin over surface 16. The water will not back up to the level of the peripheral water film inlet 52, however, as it flows first into the overflow port 60, down interior passage 62, and out the hole 66 and to the drain beneath the plug at surface 34. The water to the film from inlet passage 52 is turned off only after the plug is removed and the basin is fully drained, thereby to again clean the surface 16.

In accordance with the invention, water from passage 52 forms a film flowing smoothly over the inside surface 16 of the basin, cascading down the inside surface to the drain 32. In so flowing as a smooth and uniform film, the water film from passage 52 substantially protects the surface 16 from direct contact with soap, dirt, toothpaste, hair, shaving cream, and the like which a user may deposit into the basin 10 during use of same.

Thus the present invention provides an attractive, modern solution to the problem of detritus left by users and prior users on the inner surfaces of sinks and basins. It has application both to private household and to upscale public washroom uses, and can be rendered in many forms so long as the key water film flow feature is incorporated. It need not be used solely in bowl-form basins, but may be adapted to conventional basins and sinks both for bathroom and kitchen and bar uses.

Many variations may be made in the basin shown and its manner of use without departing from the principles of the invention as pictured and described herein and claimed as our invention. For instance, the form can be adjusted to be square, oblong, oval, or another shape, and divided into two or more basins not all of which have the water film feature. The invention resides broadly in the arrangements of the inlet channel for creating the flow film as disclosed and recited in the claims. Minor variations will not avoid the use of the invention.

I claim as my invention:

1. A basin for use with a source for supply of potable water thereto and having a spigot for normally passing said potable water into said basin for use and a drain for passing gray water therefrom, the basin being formed with a peripherally-extending wall having an interior surface for confining portions of said water in said basin between said source and said drain, the basin further comprising:

an inlet flow channel formed in the interior surface of the basin, separately from said spigot, gravitationally below a top rim of the basin formed on said wall, the inlet flow channel being directed inwardly of the basin and downwardly toward said drain and extending substantially uninterrupted about at least a major portion of said periphery of said interior surface; and a water supply passage conducting potable water between said supply source and said inlet flow channel, said passage being located outwardly of the interior surface of the basin and providing said potable water substantially uniformly to the inlet flow channel for smooth flow therethrough and to create a smoothly-flowing film of water passing from the inlet channel to the drain, which film substantially completely covers the interior surface of the basin beneath said inlet channel and protects and washes said surface of detritus falling toward said surface during use of the basin, wherein said water supply passage extends from a portion of the basin adjacent the drain to the inlet flow channel, wherein said basin also has an exterior surface and the water supply passage extends through the wall of the basin between the interior and the exterior surfaces, and wherein the water supply passage extends through the wall of the basin generally parallel to both the interior wall and the exterior wall of the basin.

2. A basin as defined in claim 1, wherein said water supply passage extends substantially uniformly about the basin outwardly of the interior surface of said basin.

3. A basin as defined in claim 1, wherein said water supply source is controlled separately from potable water supplied to the spigot.

4. A basin as defined in claim 3, wherein said separate control comprises at least one of volume and temperature control.

5. A basin as defined in claim 4, wherein said separate control comprises both volume and temperature control.

6. A basin as defined in claim 1, wherein the basin exterior surface is attractively finished and the basin is adapted to be mounted atop a domestic cabinet.

7. A basin for use with a source for supply of potable water thereto and having a spigot for normally passing said potable water into said basin for use and a drain for passing gray water therefrom, the basin being formed with a peripherally-extending wall having an interior surface for confining portions of said water in said basin between said source and said drain, the basin further comprising:

an inlet flow channel formed in the interior surface of the basin, separately from said spigot, gravitationally below a top rim of the basin formed on said wall, the inlet flow channel being directed inwardly of the basin and downwardly toward said drain and extending substantially uninterrupted about at least a major portion of said periphery of said interior surface; and a water supply passage conducting potable water between said supply source and said inlet flow channel, said passage being located outwardly of the interior surface of the basin and providing said potable water substantially uniformly to the inlet flow channel for smooth flow therethrough and to create a smoothly-flowing film of water passing from the inlet channel to the drain, which film substantially completely covers the interior surface of the basin beneath said inlet channel and protects and washes said surface of detritus falling toward said surface during use of the basin, wherein said water supply passage extends from a portion of the basin adjacent the drain to the inlet flow channel, wherein said basin also has an exterior surface and the water supply passage extends through the wall of the basin between the interior and the exterior surfaces and generally parallel to both the interior wall and the exterior wall of the basin, the basin is formed also with a peripheral overflow channel formed in the interior wall of the basin adjacent but spaced from the water inlet channel, and the overflow channel communicates within said basin wall to said drain below any stopper therein, and the communication from the overflow channel in the basin extends through the wall of the basin between the interior and exterior surfaces and separated entirely from said water supply passage.

* * * * *